US009068361B2

(12) United States Patent
Quinn

(10) Patent No.: US 9,068,361 B2
(45) Date of Patent: Jun. 30, 2015

(54) HANDRAIL SYSTEM

(75) Inventor: Matthew J. Quinn, Atlanta, GA (US)

(73) Assignee: RETROFIT VENTURES, LLC, Jacksonville, FL (US)

( * ) Notice: Subject to any disclaimer, the term of this patent is extended or adjusted under 35 U.S.C. 154(b) by 420 days.

(21) Appl. No.: 13/554,742

(22) Filed: Jul. 20, 2012

(65) Prior Publication Data

US 2013/0155679 A1 Jun. 20, 2013

Related U.S. Application Data

(60) Provisional application No. 61/630,638, filed on Dec. 16, 2011.

(51) Int. Cl.

| | |
|---|---|
| ***F21S 4/00*** | (2006.01) |
| ***F21K 99/00*** | (2010.01) |
| ***E04H 17/00*** | (2006.01) |
| ***E04F 11/18*** | (2006.01) |
| ***F21V 33/00*** | (2006.01) |

(52) U.S. Cl.

CPC ..... *E04F 11/1836* (2013.01); *F21V 33/006* (2013.01); *E04F 2011/1872* (2013.01); *E04F 2011/1821* (2013.01)

(58) Field of Classification Search

CPC ..... F21Y 2101/02; F21K 9/00; F21V 29/005; E04F 11/181; E04F 11/842

USPC ..... 256/65.01, 65.16; 362/249.02

See application file for complete search history.

(56) References Cited

U.S. PATENT DOCUMENTS

| | | | | |
|---|---|---|---|---|
| 1,775,301 | A | 9/1930 | Wiebmer | |
| 3,569,689 | A | 3/1971 | Nestrock | |
| 5,069,350 | A | 12/1991 | Wolff et al. | |
| 5,337,525 | A | 8/1994 | Zaccai et al. | |
| 6,820,290 | B1 | 11/2004 | Mullick et al. | |
| 6,922,857 | B2 | 8/2005 | Palma | |
| 7,213,276 | B2 | 5/2007 | Palma | |
| 7,901,115 | B2 * | 3/2011 | Chien | 362/397 |
| 7,926,128 | B2 | 4/2011 | Mammi | |
| 2006/0124811 | A1 | 6/2006 | Tatarsky et al. | |
| 2008/0053931 | A1 | 3/2008 | Newbould et al. | |
| 2008/0080173 | A1 | 4/2008 | Trimble et al. | |
| 2008/0184475 | A1 | 8/2008 | Sladick et al. | |
| 2010/0133218 | A1 * | 6/2010 | Yang et al. | 211/119.009 |
| 2011/0017969 | A1 | 1/2011 | Reich | |

FOREIGN PATENT DOCUMENTS

| | | |
|---|---|---|
| JP | 2008237610 | 10/2008 |

* cited by examiner

*Primary Examiner* — Joseph L Williams

(74) *Attorney, Agent, or Firm* — Baker Donelson; Dorian B. Kennedy

(57) ABSTRACT

A handrail system (10) is disclosed having an elongated handrail rod (11) coupled to handrail mounts (12) that are adapted to be mounted to a support surface. The handrail system also includes accessory devices (13) coupled to the elongated handrail. The elongated handrail rod includes a casing (16) and an internal frame (17) to form a channel (22). The accessory device includes a mounting flange (43) configured to mate with the handrail rod and an accessory holder (44). The mounting flange includes an elongated neck (45) extending to a curved top portion (46) configured to overlay the top of the handrail. The mounting flange also includes a locking member (47) configured to be received within the channel of the handrail rod.

20 Claims, 4 Drawing Sheets

HANDRAIL SYSTEM

REFERENCE TO RELATED APPLICATION

Applicant claims the benefit of U.S. Provisional Patent Application Ser. No. 61/630,638 filed Dec. 16, 2011.

TECHNICAL FIELD

This invention relates to handrails, and specifically to handrails that are adapted to include accessories.

BACKGROUND OF THE INVENTION

Handrails are often used in restrooms, bathrooms and other locations in and around bathtubs, sinks and toilets. These areas are used for bathing, showing, washing, shaving, and other generally hygienically related activities. Within these areas, other accessory devices or fixtures are oftentimes associated with these areas, such as towel racks, soap dishes, mirrors, toilet paper holders, toothbrush holders, etc. These devices are typically mounted directly to an adjacent wall or simply placed upon a counter. As such, these devices either take up wall space or counter top space and generally result in the undesired cluttering of the area.

Accessory devices have been designed to be coupled to a rail to conserve space. However, these accessory devices are typically in the form of an inverted U-shaped flange with simply fits over the top of the rail. These types of systems do not fix the device in place and the device may be easily stolen, removed or accidently dislodged from the rail.

Accordingly, it is seen that a need remains for a handrail system that maintains the position of accessory devices coupled thereto and prevents the easy separation of the accessory device from the handrail. It is to the provision of such therefore that the present invention is primarily directed.

SUMMARY OF THE INVENTION

In a preferred form, of the invention a rail system comprises an elongated handrail rod and an accessory device having a mounting flange and being coupled to the handrail rod. One of either the handrail rod. or the accessory device mounting flange has an elongated, longitudinally extending channel, and the other of the handrail rod or the accessory device mounting flange has a locking member adapted to be received within the channel. The size and shape of the locking member prevents the mounting flange from being disengaged from at least a portion of the channel.

DETAILED DESCRIPTION

Figure 1:
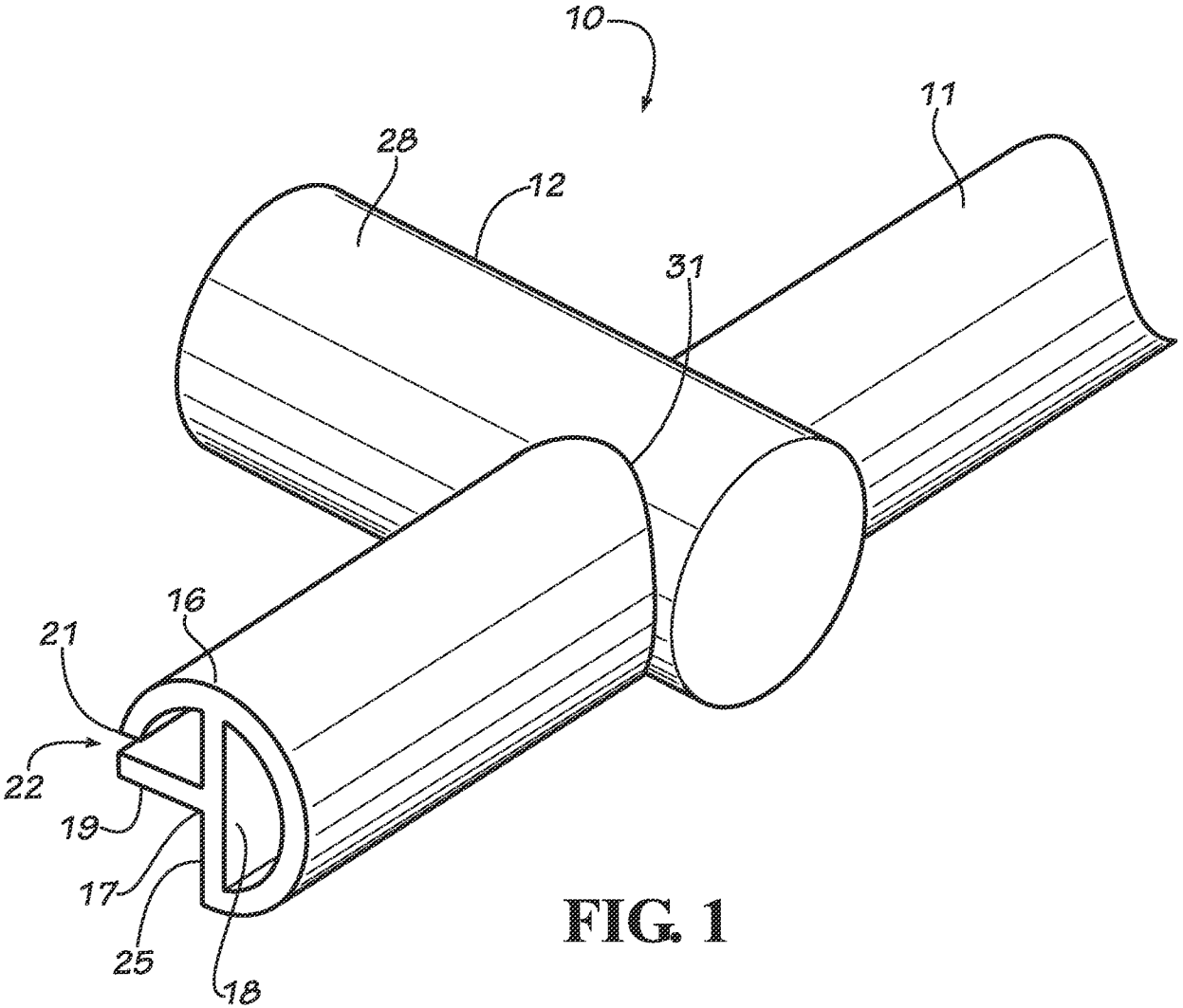
FIG. 1 is a handrail system embodying principles of the invention in a preferred form of the invention.
Figure 2:
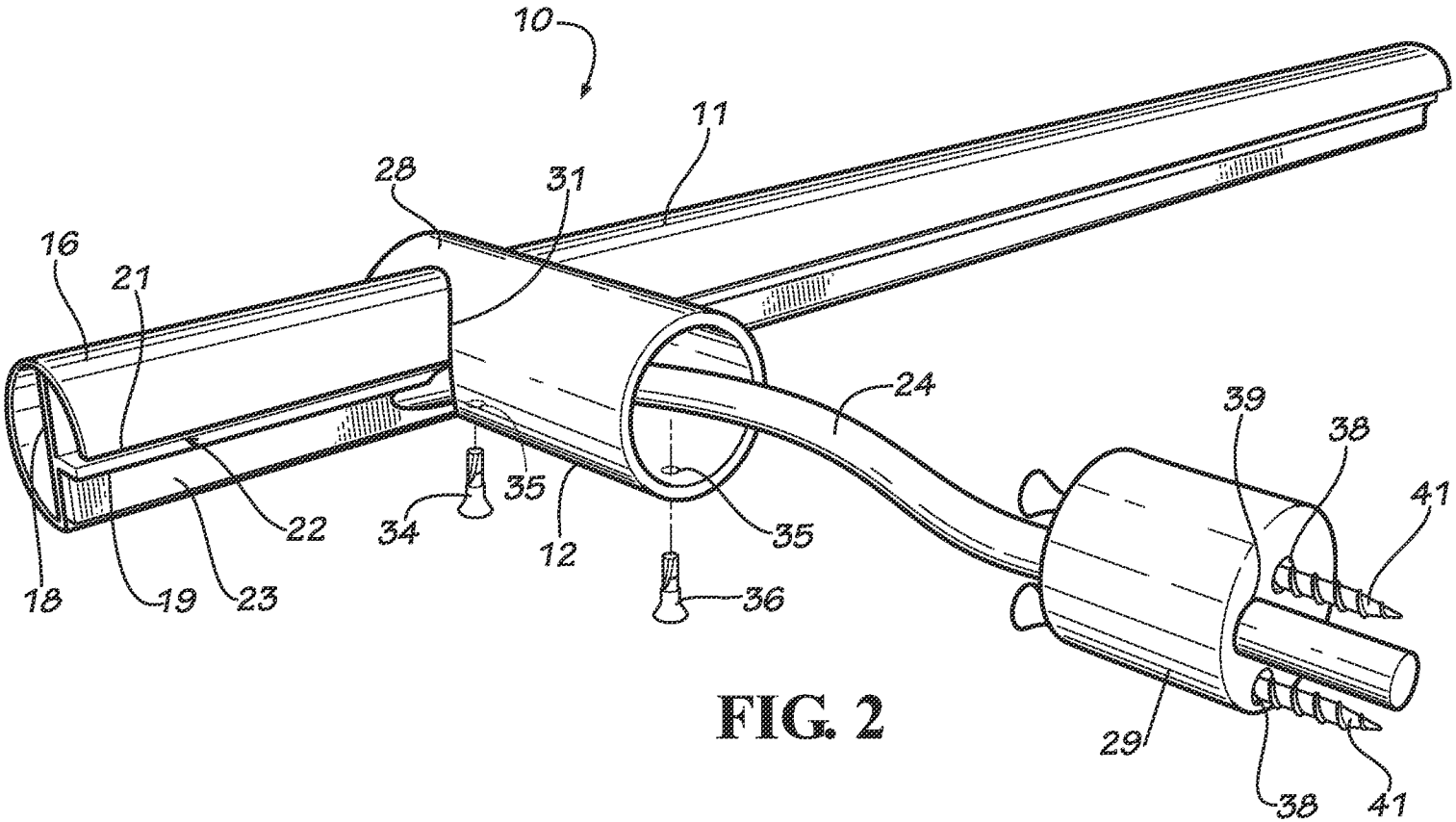
FIG. 2 is an exploded view of the handrail system, of FIG. 1.
Figure 3:
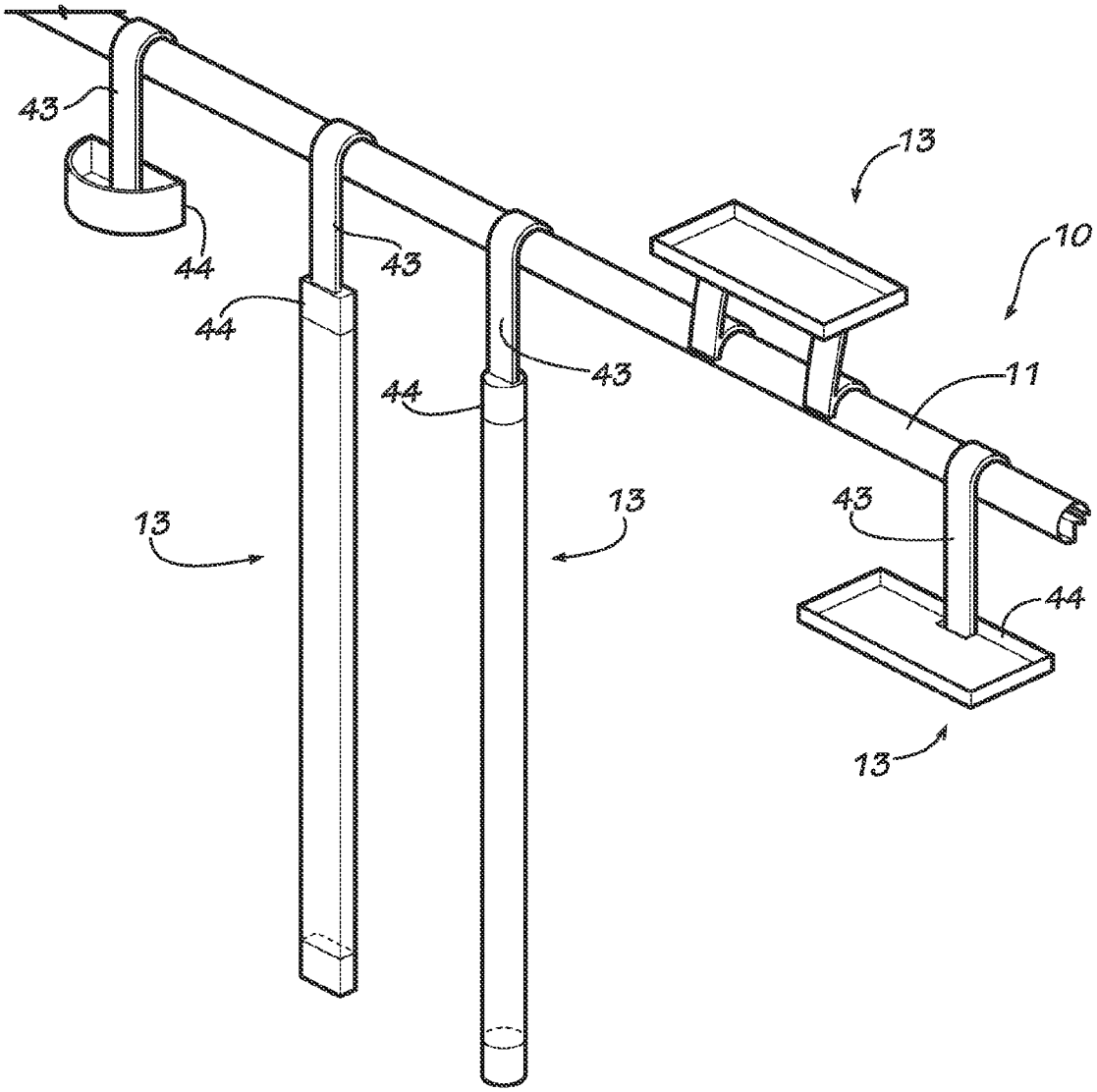
FIG. 3 is a perspective view of the handrail system showing multiple accessory devices.

With reference next to the drawings, there is shown a handrail system 10 embodying principles of the invention in a preferred form. The handrail system 10 includes one or more elongated handrails or handrail rods 11 which are coupled to handrail mounts 12 adapted to be mounted to a support surface such as a bathroom wall. The handrail system 10 also includes accessory devices 13 coupled to the elongated handrail 11.

The elongated handrail 11 includes a generally circular in cross-section outer member or casing 16 and an internal frame or support network 17. The "circular" member is shown in the form of a C-shaped member and thus the term circular is not meant to define a complete circle or a perfectly round structure. The support network 17 of the first embodiment of FIGS. 1-4 includes a first, center member 18 generally bisecting the outer member 16, and a second member 19 extending generally perpendicular to the first, center member 18. The second member 19 is spaced from a first end 21 of the outer member 16 so as to define a space, recess, groove or channel 16 therebetween, A series of lights 23, which may be in the form of low voltage LED lights may be mounted upon the wall facing surface 25 of the first, center member 18. The lights 23 are coupled to electrical conductors or conduit 24.

Each mount 12 includes a mounting tube 28 and a mounting bracket 29 configured to be nested within the mounting tube 28 and mounted to the support structure. The mounting tube 28 includes a passage 31 therethrough configured to receive the handrail 11, the configuration of which depends on whether the mount is an end mount terminating the handrail, a mid-section mount, an inside corner mount, or an outside corner mount.

The mounting tube 28 includes a first set screw hole 33 in which is mounted a first set screw 34 adapted to seat firmly against the captured handrail. The mounting tube 28 also includes a second set screw hole 35 in which is mounted a second set screw 36 adapted to seat firmly against the mounting bracket 29.

The mounting bracket 29 includes first and second mounting screw holes 38 and an electrical conduit passageway 39 through which electrical conductor 24 extends. The electrical conductor 24 is coupled to conventional electrical wiring within the structure to power the lights and thereby provide an indirect lighting of the handrail through the illumination of the adjacent or underlying support structure. A mounting screw 41 is mounted within each screw mounting hole 38 to secure the mounting bracket in place upon the supporting structure.

The accessory device 13 includes a mounting flange 43 configured to mate with the handrail 11 and an accessory holder or device 44. It should be understood that the accessory holder 44 may be in many different forms, such as, but not limited to, a holder designed to be a soap dish, a shampoo bottle tray, a magazine rack, a bath towel rack, a face towel holder, a mirror, a lighting device, a toilet paper holder, a toothbrush holder, etc.

The mounting flange 43 includes an elongated neck 45 extending to a curved top portion 46 configured to overlay or nest upon the top of the handrail 11. The mounting flange 43 also includes a tongue, tang, or locking member 47 configured to be received within the channel 22 of the handrail. The mounting flange locking member 47 has a first horizontally oriented, inwardly extending member 48 and a second vertically oriented member 49 which is oriented at an oblique angle to the first member.

The locking member 47 is configured so that the accessory device may be moved horizontally along the elongated length of the handrail, when set screw 34 is not tightened, yet prevent the unwanted removal of the accessory device from the handrail. The locking member first horizontal member 48 fits against and abuts the internal support network 17, and especially the horizontally oriented second frame member 19. It should be understood that while the locking member first and second members 48 and 49 extend into the handrail channel 22, the locking member second, vertical member 49 aids in preventing the removal of the accessory device by abutting the interior surface of the handrail. This also may be accomplished through a longer length of the first horizontal member 48 without the need for the additional second, vertical member 49 as shown hereinafter.

In use, the accessory device 13 is coupled to the handrail 11 by sliding the locking member 47 of the mounting flange 43 into the open end of the handrail 11. The handrail 11 is then coupled to the appropriate handrail mount 12, the configuration of the handrail mount 12 may close off the open end of the handrail or may necessitate the mounting of a handrail end cap to close off the open end. The exact position of the accessory device 13 may then be chosen and the accessory device slid to that location upon the handrail. Should it be desired to fix the location of the accessory device upon the handrail an unshown set screw may be extended through the mounting flange 43 and into abutment with the handrail.

The mounting of the handrail mounts 12 is accomplished by positioning the mounting bracket 29 at the appropriate location upon the support structure and threadably securing the mounting screws 41 therein. The mounting tube 28 is then telescopically positioned over the mounting bracket 29 and secured in place through the tightening of the second set screw 36. The first set screw 34 is then tightened to lock the position of the handrail 11 onto the handrail mount 12.

Figure 5:
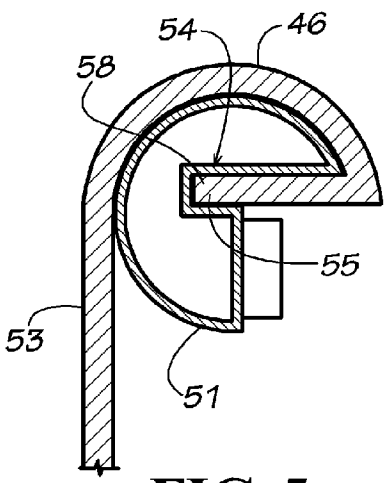
FIG. 5 is a cross-sectional side view of a handrail in another preferred form of the invention.
Figure 4:
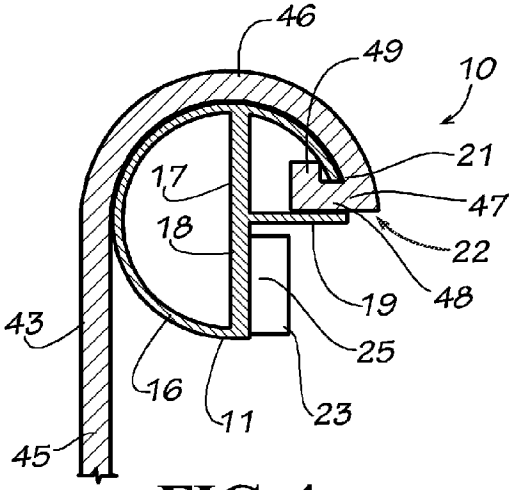
FIG. 4 is a cross-sectional side view of the handrail system of FIG. 1.

With reference next to FIG. 5, there is shown a handrail 51 and mounting flange 53 is another preferred form of the invention. Here, the construction is similar to that previously disclosed except for the configuration of the handrail channel 54 and the corresponding tongue or locking member 55. The locking member 55 has an elongated, first horizontal member 58 the length of which and the curvature of the bracket curved top portion 46 prevents it from being removed from the handrail channel 54. The first horizontal member 58 is in abutment with the internal support network of this configuration and thereby captured by the channel 54.

Figure 6:
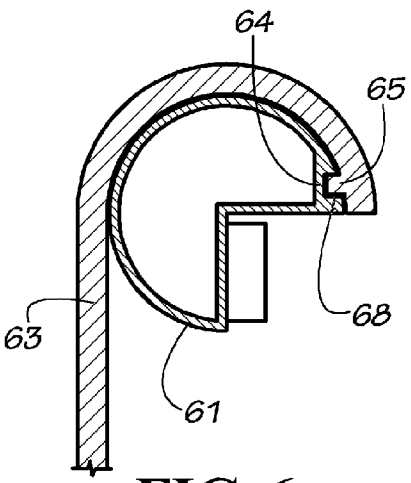
FIG. 6 is a cross-sectional side view of a handrail in another preferred form of the invention.

With reference next to FIG. 6, there is shown a handrail 61 and mounting flange 63 is another preferred form of the invention. Here, the construction is similar to that previously disclosed except for the configuration of the handrail channel 64 and the corresponding tongue or locking member 65. The locking member 65 has a shorter, first horizontal member 68 but the curved top portion extends past the first, horizontal member 68 which helps in preventing it from being removed from the handrail channel 64. The first horizontal member is in abutment with the internal support network of this configuration and thereby captured by the channel 64.

Figure 7:
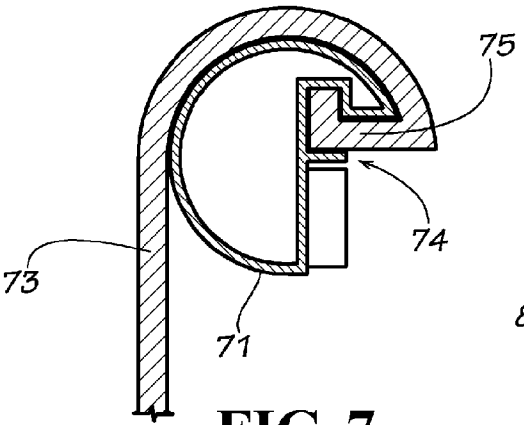
FIG. 7 is a cross-sectional side view of a handrail in another preferred form of the invention.

With reference next to FIG. 7, there is shown a handrail 71 and mounting flange 73 is another preferred form of the invention. Here, the construction is similar to that previously disclosed except for the configuration of the handrail channel 74 and the corresponding tongue or locking member 75. The channel 74 is shown as a completely enclosed channel rather than the open channels of the first embodiment. The complete encasing or abutment of the channel provides superior strength capabilities while still preventing the accessory device from being removed from the handrail.

Figure 8:
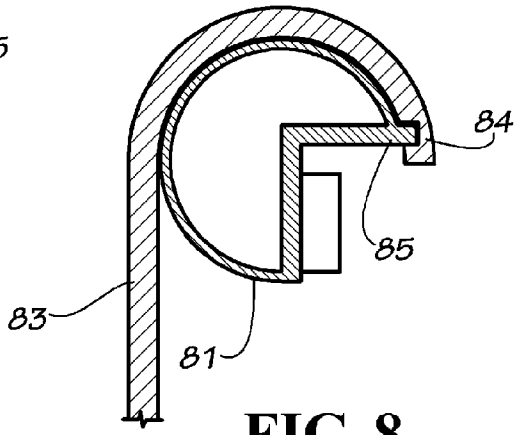
FIG. 8 is a cross-sectional side view of a handrail in another preferred form of the invention.

With reference next to FIG. 8, there is shown a handrail 81 and mounting flange 83 is another preferred form of the invention. Here, the construction is similar to that previously disclosed embodiment except for the configuration of the handrail channel 84 and the corresponding tongue or locking member 85 and the relative orientation of the tongue or locking member and the channel, i.e., the orientation being essentially reversed. Now, the mounting flange 83 includes the elongated channel 84 and the handrail 81 includes a tongue or locking member 85 to prevent it from being removed from the handrail channel 84. Again, the first horizontal member is in abutment with the internal support network of this configuration and thereby captured by the channel.

It should be understood that the present embodiment is not limited to "circular" handrails and may include handrails of any shape, including oval, square, rectangular, a polygon shape, or any combination of straight and curved portions.

It should also be understood that rather than mounting the accessory devices through the ends of the handrails, the channel 22 may be configured with an enlarged portion or gap, preferably proximate the end, to receive the mounting flange. This option enables one to mount the accessory device without having to remove end caps or possibly disengage the handrail from its associated mounts. The majority of the channel however is configured to enable the locking of the accessory device.

It thus is seen that a handrail system is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A handrail system comprising:

at least one handrail mount adapted to be mounted to a support surface;

an elongated handrail rod having a front side, a rear side, a top side, and a longitudinal length and being coupled to said at least one handrail mount, said handrail rod having an elongated, longitudinally extending channel extending from said rear side, and an accessory device coupled to said handrail rod, said accessory device having a fixed mounting flange with a fixed horizontally extending locking member adapted to be received within said handrail rod channel, said fixed mounting flange extending about said elongated handrail rod so as to overlay a portion of said front side, a portion of said rear side, and said top side, and the size and shape of said locking member preventing the mounting flange from being gravitationally disengaged from at least a major portion of said handrail rod channel.

2. The handrail system of claim 1 wherein said fixed mounting flange includes a first member sized and shaped to be received within said handrail rod channel.

3. The handrail system of claim wherein said fixed mounting flange further includes a second member extending from said first member which is also sized and shaped to be received within said handrail rod channel.

4. The handrail system of claim 3 wherein said first member is oriented generally horizontally and said second member is oriented generally vertically.

5. The handrail system of claim 2 wherein said handrail rod includes interior walls configured to fit against and abut said first member.

6. The handrail system of claim 1 further comprising lights coupled to said handrail rod.

7. The handrail system of claim 6 wherein said lights are a plurality of LEDs.

8. A handrail system comprising:

an elongated handrail rod, and an accessory device having a fixed mounting flange and being coupled to said handrail rod, one of either said handrail rod or said accessory device mounting flange having an elongated, longitudinally extending channel, and said other of said handrail rod or said accessory device fixed mounting flange having a fixed and stationary locking member adapted to be received within said channel, the size and shape of said fixed and stationary locking member preventing the mounting flange from being gravitationally disengaged from at least a portion of said channel.

9. The handrail system of claim 8 wherein said fixed mounting flange includes a first member sized and shaped to be received within said channel.

10. The handrail system of claim 9 wherein said fixed mounting flange further includes a second member extending from said first member which is also sized and shaped to be received within said channel.

11. The handrail system of claim 10 wherein said first member is oriented at an oblique angle to said second member.

12. The handrail system of claim 9 wherein said channel includes interior walls configured to fit against and abut said first member.

13. The handrail system of claim 8 further comprising lights coupled to said handrail rod.

14. The handrail system of claim 13 wherein said lights are a plurality of LEDs.

15. A handrail system comprising:

at least one handrail mount adapted to be mounted to a support surface;

an elongated handrail rod having a longitudinal length and being coupled to said at least one handrail mount, and an accessory device coupled to said handrail rod, said accessory device having a fixed and stationary mounting flange with an elongated, longitudinally extending channel, said handrail rod having a fixed and stationary locking member adapted to be received within said mounting flange channel, the size and shape of said fixed and stationary locking member preventing the fixed and stationary mounting flange from being gravitationally disengaged from at least a portion of said handrail rod channel.

16. The handrail system of claim 15 wherein said fixed and stationary mounting flange includes a first member sized and shaped to be received within said channel.

17. The handrail system of claim 16 wherein said fixed and stationary mounting flange further includes a second member extending from said first member which is also sized and shaped to be received within said channel.

18. The handrail system of claim 17 wherein said first member is oriented generally horizontally and said second member is oriented generally vertically.

19. The handrail system of claim 16 wherein said channel includes interior surfaces configured to fit against and abut said first member.

20. The handrail system of claim 1 further comprising lights coupled to said handrail rod.

* * * * *